US005208940A

United States Patent [19]

London, Charles A. et al.

[11] Patent Number: 5,208,940

[45] Date of Patent: May 11, 1993

[54] FLOOR DRYER AND WARNING DEVICE

[76] Inventors: London, Charles A., 4325 Hermosa, Corpus Christi, Tex. 78411; George A. Schultz, 176 Ohio, New Braunfels, Tex. 78130

[21] Appl. No.: 607,677

[22] Filed: Nov. 1, 1990

[51] Int. Cl.[5] ..... A47L 7/00

[52] U.S. Cl. ..... 15/345; 15/329; 15/339; 15/353; 34/90

[58] Field of Search ..... 15/320, 321, 345, 329, 15/353, 339; 34/90, 91, 243 R

[56] References Cited

U.S. PATENT DOCUMENTS

| | | | |
|---|---|---|---|
| 3,286,368 | 11/1966 | Thomas | 34/243 R |
| 3,606,631 | 9/1971 | Vassh et al. | 15/321 |
| 3,663,984 | 5/1972 | Anthony et al. | 15/321 |
| 3,720,977 | 3/1973 | Brycki | 15/321 |
| 3,774,262 | 11/1973 | Anthony et al. | 15/322 |
| 3,780,397 | 12/1973 | Harbeck et al. | 15/413 |
| 3,848,290 | 11/1974 | Bates | 15/321 |
| 3,964,925 | 6/1976 | Burgoon | 134/21 |
| 4,151,627 | 5/1979 | Wisdom | 15/321 |
| 4,227,279 | 10/1980 | Tribolet | 15/321 |
| 4,228,885 | 9/1981 | Parise | 15/321 |
| 4,492,002 | 1/1985 | Waldhauser et al. | 15/320 |
| 4,571,849 | 2/1986 | Gardner et al. | 34/243 R X |
| 4,809,397 | 3/1989 | Jacobs et al. | 15/321 X |
| 5,048,202 | 9/1991 | Shero | 34/243 R X |

*Primary Examiner*—Chris K. Moore

*Attorney, Agent, or Firm*—Hubbard, Thurman, Tucker & Harris

[57] ABSTRACT

A device for removing liquid and small particulate matter from various surfaces is provided. The device includes a single compartmentalized enclosure supporting a rechargeable battery, a vacuum source and an airflow booster system for drying the surface. As liquid and particulate matter are vacuumed via a hose or other vacuum director, they are trapped in a removable reservoir container which may be detached from the device for emptying and cleaning. The exhaust air produced from the resident vacuum system may be accelerated by a booster system which redirects accelerated airflow through a set of louvers toward the damp spot left by the removed liquid. The booster system may be used individually, without the aide of exhaust airflow from the vacuum, to also effect such drying of the surface. The device also has attached a signal system to alert passersby of the hazard created by the damp surface supporting the device in the preferred embodiment. All electronic functions of the device are adapted to be operated from a rechargeable battery power source which may be removed from the device for recharging or may be recharged in place via a recharging socket.

30 Claims, 2 Drawing Sheets

FLOOR DRYER AND WARNING DEVICE

BACKGROUND OF THE INVENTION

In the restaurant industry and other industries where public traffic is required, many times the situation arises where water or other liquid has been inadvertently left on the floor or other surfaces. The liquid creates a slipping hazard to passersby. Even after removal of the liquid, a damp spot remains, creating a still further hazard. The damp spot is normally left uncovered in order to dry by exposure to normal air. In practice, many times a warning "teepee" is placed over this area to alert patrons or personnel of the slipping hazard created by the damp spot. The present invention allows for a portable and compact system to remove such liquid, accelerate the drying of the damp area left by such removal and warn passersby of the hazard created by the damp area. The applicable art to the present invention relates generally to wet-dry vacuum cleaners and, more specifically, to wet-dry carpet cleaner apparatus which channels the exhaust airflow from a vacuum motor through a series of hoses and onto the carpet to aid in the drying of the carpet as the cleaner is repeatedly drawn across it.

It is known in the art to provide complex systems of rotating impellers and tortuous path airflow to create a vacuum system which allows the separation of liquid and particulate matter from the working air. U.S. Pat. No. 3,780,397, by Harbeck et al, discloses such a device. Harbeck discloses a wet-dry suction cleaner which utilizes two streams of air to achieve a cooling of the driving motor without wetting of the motor windings by liquid suspended in the working air.

While the arrangement discussed by Harbeck assures longevity of the motor windings, it is complex and expensive in construction. Further, it does not achieve a utilization of the exhaust air created by the vacuum source to accelerate drying of the surface cleaned.

A similar wet-dry vacuum canister is disclosed in U.S. Pat. No. 3,848,290 by Bates. Bates teaches that a labyrinth system of annular passages allows the working air to be separated from the cooling air which is intaken into the windings of the vacuum unit to cool the motor. Bates additionally teaches the use of a separate hand held nozzle to direct the vacuum produced by the wet-dry motor and further to inject tap water onto the surface to be cleaned. As with Harbeck, the implementation of the Bates device is expensive and complex, requiring in addition to the complex vacuum motor, a set of connecting hoses, a hand held nozzle, and connection to a source of tap water under pressure.

The art also discloses many such devices which employ multiple free-standing canisters specifically designed to carry out portions of the vacuum, liquid injection and air injection tasks required in the cleaning of floor coverings.

U.S. Pat. No. 3,964,925, by Burgoon, discloses a system of two free-standing, movable units connected by a series of hoses for use in cleaning in carpets. Burgoon teaches that a high-powered, wet-dry vacuum source may be used in conjunction with a separate movable nozzle unit. The nozzle unit directs a flow of detergent and the vacuum produced by the vacuum motor onto the carpet being cleaned. Burgoon further teaches that the exhaust produced from the vacuum motor may be channeled through a hose to the nozzle unit to aide in the dispersal of the detergent onto the carpet surface. A secondary usage Burgoon makes of this exhaust air is to aid in the partial drying of the carpet upon repeated passes of the nozzle unit over the carpet.

The device taught in Burgoon is complex to construct, assemble and use. Further, it is expensive and requires at least two men to operate it.

Similar, yet more complex, devices are disclosed in U.S. Pat. Nos. 3,663,984 and 3,774,262, both by Anthony et al. These patents teach a complex system of canisters connected through a plurality of hoses to a large movable vacuum head nozzle. In addition to a single canister which produces the required vacuum suction, these patents introduce the complexities of two air compressor pumps, a solution heater system and multiple pressure correction devices. Exhaust air generated by the vacuum pressure pump is channeled through a flexible hose from one of the canisters to the vacuum nozzle, which in turn directs such exhaust air toward the carpet for the purpose of facilitating drying with multiple passes of the vacuum head nozzle.

These patents, however, do not address the need for an inexpensive and compact system for picking up limited amounts of liquid and particulate matter and then drying the damp surface left behind without repeated movement of a nozzle.

Additionally, none of the disclosed devices in the prior art teach a single compact unit which allows liquid to be picked up by a vacuum source which is then stationed on the surface to complete the drying thereof without repeated movements across such surface, and without the constant attention of the user.

Further, the prior art does not disclose the use of a secondary and more efficient booster fan to redirect and accelerate the exhaust output by the vacuum source. Still further, none of the prior art discloses an incorporated, removable container to easily and quickly dispose of limited amounts of waste liquid and particulate matter raised by the vacuum source.

Additionally, none of the disclosed devices in the prior art teach the combination of a wet-dry vacuum system with safety elements to allow for signaling of the public or other users of the device of the danger presented by the damp surface left behind after the vacuuming process.

Therefore, it is desirable to provide a single unit which provides an economical method of picking up limited amounts of liquid and particulate matter from a surface, and efficiently drying the damp surface left behind without repeated movement of the device. Furthermore, it is desirable to provide a unit which may be operated by one person and may be left unattended during the drying phase of its operation. Additionally, it is desirable to achieve the cleanup and drying of a surface with a single compact unit which is economical to manufacture and of low cost to operate. It is also desirable to provide an easy method of removing the waste liquid raised by the vacuum source. Additionally, it is desirable to provide a signaling means during the drying phase of the operation to alert and warn the public or other users of the apparatus of the danger presented by the damp surface left behind after the vacuuming process has been completed.

SUMMARY OF THE INVENTION

This invention provides an device and method for vacuuming liquid and small particulate matter from a surface and then efficiently drying the damp area left behind after such procedure while unattended. The invention further possesses the attribute of a means to signal passersby of the hazard created by the damp surface before it is completely dry and block the surface from pedestrian traffic. The invention carries out at least four goals. First, it easily and economically removes liquid and particulate matter from a surface. Second, it is compact, portable and can be used by one person or left in operation while unattended. Third, it accelerates the drying of said surface. Finally, it warns passersby of the hazard created by the damp surface, and covers the spot to prevent accidents.

In the preferred embodiment of the present invention, a single canister mounted on small wheels is used to house a vacuum motor and an impeller driven by portable nickel cadmium batteries. The vacuum motor and impeller are connected through a duct to a vacuum chamber which houses a removable container at its base. The removable container forms a reservoir into which the liquid suctioned off the surface is retained.

A vacuum hose is connected through a nipple fitting to the side of the vacuum chamber and forms a duct directed downward into the removable container. Onto the nipple a corrugated hose or other attachment is fitted which extends outwardly and downwardly to meet the surface onto which the liquid and particulate matter to be suctioned is resident.

The exhaust from the vacuum motor and impeller is directed inwardly into a chamber resident within the container which forms the housing of the device. This chamber has an open bottom through which the exhaust air is directed back to the surface supporting the device. A secondary booster fan may be mounted in the direct path of this exhaust air and which in operation acts to accelerate the exhaust airflow to impinge on the surface supporting the device.

In an alternative embodiment, no secondary booster fan is present within the stream of the exhaust airflow produced by the vacuum motor and impeller. In this embodiment, the redirected exhaust airflow from the vacuum motor and impeller is used alone to speed the drying of the damp surface.

In either case, a system of louvers may be provided across the bottom opening directly in the path of exhausted airflow. These louvers may be used in conjunction with the booster fan to redirect and concentrate the accelerated air from the booster fan and the airflow created by the vacuum motor and impeller, or to redirect and concentrate the airflow created by the vacuum motor and impeller alone.

During operation of the device, the booster fan and vacuum motor may also be operated concurrently to create a strong downdraft airflow from the bottom of the device onto the surface supporting the device to further aid in its drying.

In an alternative operation, the booster fan may be operated independently of the vacuum motor, thereby creating airflow to impinge on the surface supporting the device without the aid of the exhaust airflow created by the vacuum motor and the impeller. This mode of operation conserves the limited current available from the battery power supply while allowing for the accelerated drying of the surface.

On the outside of the device in the preferred embodiment, a circumferential ring of flashing lights is attached near the top of the enclosure. This ring of flashing lights serves as an indicator beacon to warn passersby of the hazard formed by the damp spot immediately below the device.

Additional or alternative signaling systems may be incorporated into the device, including audible warning devices, a brightly colored plastic enclosure, bold signs attached to the plastic enclosure, an indicator beacon, or flags suspended at eye level by a pole attached to the enclosure. Each of these signaling systems serves to alert users to the presence of the device and the slipping hazard it covers.

In operation, the device is positioned adjacent to liquid resident on a surface, which may be similar to that from spilled restaurant beverages. At least the vacuum motor is switched on, at which time the vacuum hose is moved over the liquid on the surface. The liquid and small particulate matter become airborne in the airflow provided by the vacuum motor and are transmitted within the vacuum hose into the vacuum chamber. As the airflow velocity decreases after exiting the end of the vacuum hose fitting into the vacuum chamber, the liquid and particulate matter drop into the reservoir container at the bottom of the vacuum chamber. The air is then drawn in through the impeller and into the interior of the device to be redirected and exhausted through the bottom of the device toward the surface supporting the device.

In the preferred embodiment, as the airflow passes through the device, an accelerating booster fan increases the velocity of the exiting airflow and forceably directs it toward the surface to be dried. An alternative operation of the device allows the booster fan to be operated singularly thus resulting in the acceleration of the airflow in a direction toward the damp surface without the use of exhaust airflow from the vacuum motor. In either alternative, the airflow then passes through a system of louvers to redirect and further concentrate the exiting airflow.

After the liquid and particulate matter have been removed in large part leaving only a damp spot, the entire unit is stationed directly over the damp spot to cover and aid in its drying and the indicator light is activated to further warn passersby of the hazard.

BRIEF DESCRIPTION OF THE DRAWINGS

Further features and advantages will become apparent from the following detailed description of the preferred and other embodiments of the invention, as illustrated in the accompanying drawings in which like reference characters refer to the same elements or functions throughout the views, and in which.

DETAILED DESCRIPTION OF THE PREFERRED EMBODIMENT

Figure 1:
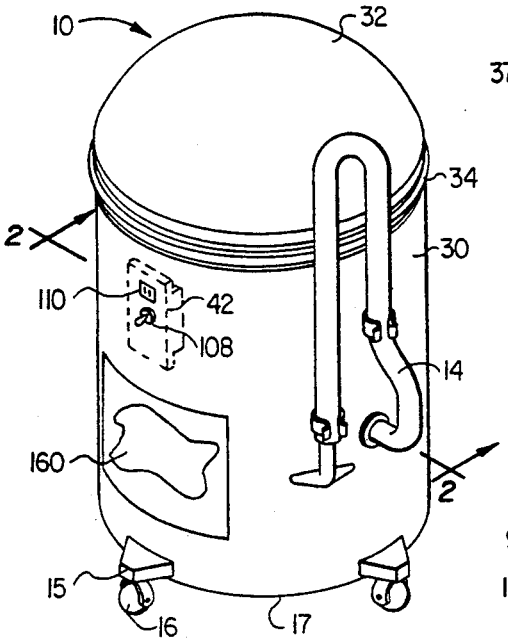
FIG. 1 is a perspective view illustrating the preferred embodiment of the floor dryer and warning device.

FIG. 1 illustrates a perspective view of a floor dryer and warning device 10. Floor dryer and warning device 10 includes wheels 16 attached to spacer 15 connected to base 17. Wheels 16 provide a convenient means for moving and stationing of the device 10 for cleaning and drying at various surface locations. A vacuum director hose 14 attached to the side of apparatus 10 as explained below, is at least long enough to reach the surface on which the device rests.

Figure 2:
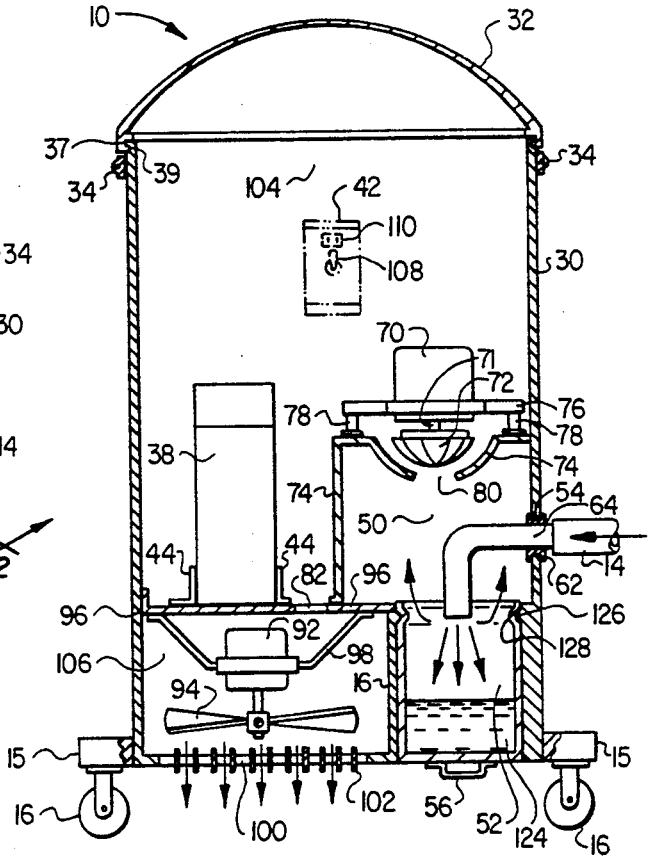
FIG. 2 is a sectional cutaway view of the floor dryer and warning device along the section lines 2—2 denoted in FIG. 1.

Referring now to FIG. 2, a cutaway diagram illustrates the various internal compartments and locations of the internal elements of the preferred embodiment of the floor dryer and warning device 10. The floor dryer and warning device 10 is self-contained in a supporting enclosure made up of a supporting frame 30 and an access closure 32. It is anticipated that supporting frame 30 and access closure 32 will be made from flexible formed plastic. In the preferred embodiment, brightly colored of flexible formed plastic is used in construction of the supporting frame in order to draw attention to the floor dryer and warning device when it is used to warn passersby of a slipping hazard. It is understood that the sign 160 might be painted, or otherwise decorated to convey a warning to onlookers.

The access closure 32 incorporates on the interior side of its circumference an annular groove 37. Annular groove 37 is adapted to sealingly mate with a matching yet inverse annular groove 39 formed into the top outside circumference of supporting frame 30. When annular groove 37 is fitted against the mating inverse annular groove 39 by slightly expanding the circumference of access closure 32 and snapping annular groove 37 over annular groove 39, the two mating annular grooves, through their elastic nature, form an airtight seal between access closure 32 and supporting frame 30. The seal also ensures an airtight environment with respect to a plenum chamber 104. Removal of the access closure 32 allows easy maintenance and cleaning of the internal components of the floor dryer and warning device 10 and allows for convenient replacement of a rechargeable battery 38 located within.

As illustrated in FIG. 1, supporting frame 30 forms a cylindrical outside shape. It should be noted that other shapes of supporting frames may be included within the spirit of the invention.

Referring again to FIG. 2, the supporting frame 30 is formed so its interior supports the internal components and compartments required for the operation of the floor dryer and warning device 10. The supporting frame 30 of the preferred embodiment includes two internal compartments: the vacuum chamber 50, and an exhaust chamber 106. The supporting frame 30 of the preferred embodiment, in cooperation with access closure 32 form a third internal compartment: plenum chamber 104.

Vacuum chamber 50 is formed by the cooperation of pressure duct 74, support shelf 96, reservoir container 52, and a section of the internal surface of the supporting frame 30 as shown in FIG. 2. Vacuum chamber 50 is sealed with respect to the exterior of the supporting frame 30 with the exception of access hole 54. Access hole 54, which is formed in a sidewall 31 of supporting frame 30, provides an opening into vacuum chamber 50. The interior of access hole 54 is adapted to sealingly mate with the outside surface of an elastic seal grommet 62.

Elastic seal grommet 62 also supports the exterior surface of right angle tube 64 in a position to direct airflow downward into reservoir container 52 in vacuum chamber 50. Right angle tube 64 is sealingly mounted in access hole 54 by elastic seal grommet 62, which forms an airtight seal around the outside of right angle tube 64, with respect to vacuum chamber 50. Right angle tube 64 is preferably a hollow, plastic tube which extends from the interior of vacuum chamber 50 to the exterior of device 10 where it is sealingly connected to the vacuum director hose 14.

Figure 5A:
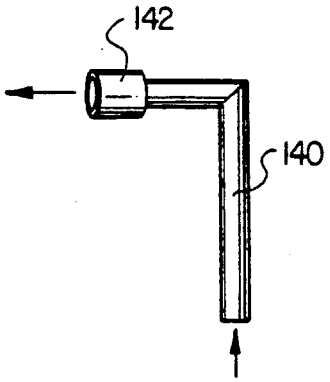
FIG. 5A shows a perspective view illustrating a rigid nozzle alternative vacuum director hose.
Figure 5B:
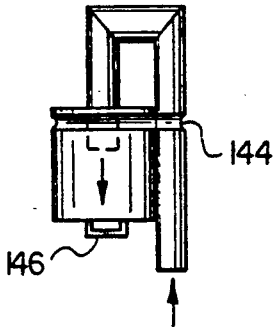
FIG. 5B shows a prospective view illustrating a preferred embodiment of the rigid nozzle fused with the reservoir container.

It should be noted that vacuum director hose 14 may be replaced by a rigid nozzle 140 as shown in FIG. 5, and which performs the same function as vacuum director hose 14. As with vacuum director hose 14, the rigid nozzle is sealingly connected to right angle tube 64. However, rigid nozzle 140 employs a flexible coupling 142. Flexible coupling 142 is adapted to sealingly mate with the portion of right angle tube 64 which is exterior to supporting frame 30. Flexible coupling 142 is also adapted to sealingly mate with the upper exterior circumference of rigid nozzle 140. Rigid nozzle 140 is adapted to reach the surface on which the device rests, and direct the negative pressure created in vacuum chamber 50 by rotary motor 70 in association with air impeller 72. It is anticipated that rigid nozzle 140 will be made from rigid formed plastic.

In an alternative embodiment, rigid nozzle 140, right angle tube 64, and reservoir container 52 may be formed in one piece, forming a fused unit 138. In this embodiment, shown in FIG. 5B, the rigid nozzle 140 and reservoir 52 may be formed in a cylindrical shape in order to mate with access portal 124. A groove 144 is formed in the fused unit 138 which is adapted to sealingly mate with annular ring 126 within access portal 124 as seen in FIG. 2. A reservoir handle 146 is provided on the lower side of the reservoir container on the fused unit 138 and allows for insertion and withdrawal of the fused unit 138 similar to that insertion and withdrawal of reservoir container 52 into access portal 124. Further in this embodiment, access hole 54 in supporting frame 30 does not exist, and when fused unit 138 is inserted in access portal 124 of the preferred embodiment, annular ring 126 in access portal 124 sealingly mates with groove 144 in fused unit 138 to form an airtight seal between vacuum chamber 50 and the exterior of the supporting frame. In addition to the air-tight seal, the mating relation of annular ring 126 and groove 144 frictionally suspends fused unit 138 in its operational position within access portal 124 in the preferred embodiment.

Vacuum chamber 50 is sealed with respect to the interior of supporting frame 30 with the exception of intake 80. Intake 80 is adapted to form a hole in pressure duct 74 directly below and concentrically aligned with the axis of rotation of an air impeller 72.

As also can be seen from FIG. 2, removable reservoir container 52 forms the bottom portion of vacuum chamber 50. The supporting frame 30 forms a mating access portal 124 adapted to accept reservoir container 52. At the top of access portal 124 and around its internal circumference is convex annular ring 126 facing the interior of vacuum chamber 50. An inverse annular groove 128 is formed in the top exterior circumference of reservoir container 52, and is adapted to sealingly mate with annular ring 126 in access portal 124. As reservoir container 52 is pushed into access portal 124, annular ring 126 snaps into annular groove 128 in a mating relation to form an airtight seal between the interior of reservoir container 52 and the exterior of supporting frame 30. The airtight seal provided by the mating annular ring 126 and the annular groove 128 forms not only an airtight closure for vacuum chamber 50, but also a frictional support for reservoir container 52. This frictional support maintains reservoir container 52 in its operational position in access portal 124.

To remove reservoir container 52 from access portal 124 to allow the dumping of liquid resident in the container, reservoir handle 56 is grasped from the bottom of the device and gently is pulled, disengaging annular groove 128 from annular ring 126 in access portal 124. The disengagement of annular groove 126 from annular ring 128 breaks the airtight seal and allows the removal of reservoir container 52. The container may then be dumped, cleaned, re-inserted into access portal 124 and again pressed into position snapping annular ring 126 into annular groove 128 thus resealing vacuum chamber 50. The elastic nature of annular ring 126 and annular groove 128 allows repeated withdrawal and insertion of reservoir container 52 without damage to the mating surfaces.

Plenum chamber 104 is formed through the cooperation of the interior surface of supporting frame 30, the interior of access closure 32, the top surface of support shelf 96 and the surface of pressure duct 74 exterior to vacuum chamber 50 as shown in FIG. 2. In the preferred embodiment, plenum chamber 104 is sealed with respect to the exterior of supporting frame 30. It should be noted that in alternate embodiments, plenum chamber 104 ma not be sealed with respect to the exterior of supporting frame 30. In such an embodiment, holes or other openings in supporting frame 30 or access closure 32 may allow intake of fresh air into plenum chamber 104, and form an outlet for the exhaust airflow formed by the operation of a rotary motor 70 and an air impeller 72 which will be further described below.

In the preferred embodiment of the floor dryer and warning device, plenum chamber 104 communicates with exhaust chamber 106 through one or more openings 82 in support shelf 96. The openings 82 form open air passageways between plenum chamber 104 and exhaust chamber 106.

Plenum chamber 104 acts primarily to redirect airflow exhausted from air impeller 72 to openings 82. However, plenum chamber 104 also houses a controller 42, a rechargeable battery 38 and various conductors 40. Controller 42 is mounted in such a way to the interior of plenum chamber 104 that switch 108 extends to the exterior of supporting frame 30 to allows access from outside the device. Controller 42 may include a four position switch 108 which orchestrates the electronic functions of the device and will be described further below. Controller 42 may also include a recharge socket 110 which serves to connect the rechargeable battery 38 to a battery recharger (not shown). As an alternative to replacing the rechargeable battery 38 when its current is depleted, recharge socket 110 may be connected to the battery recharger. Controller 42 may also contain electronic timer or strobe circuits to control the flashing of indicator lights or indicator beacon 34 or audible warnings. Such timers and circuits are well known in the art and will not be described here.

The rechargeable battery 38 of the device in the preferred embodiment is a rechargeable nickel cadmium battery connected via conductors 40 to the controller 42. The controller distributes current from the rechargeable battery 38 to rotary motor 70, booster motor 92 and indicator lights or beacon 34 via multiple position switch 108, and additional conductors 40. In the preferred embodiment, conductors 40 may include wire of suitable gauge to support current flow from the rechargeable battery 38 to the rotary motor 70, booster motor 92 and indicator light 34.

Battery supports 44 are each rigidly mounted to the top of support shelf 96 and are adapted to allow the rechargeable battery 38 to be removed and replaced easily for quick servicing of the device. Battery supports 44 frictionally engage and hold the rechargeable battery 38 in its functional position within the device.

It should be noted that in an alternative embodiment of the device, rechargeable battery 38 is not present. In this embodiment, controller 42 is connected via conductor 40 to a source of normal household current through an extension cord (not shown), which provides the power to activate rotary motor 70, booster motor 92 and indicator light 34 via multiple position switch 108, and further conductors 40.

As seen in FIG. 2, the plenum chamber 104 and vacuum chamber 50 are formed in part by pressure duct 74. Pressure duct 74 is used in conjunction with the air impeller 72 and the rotary motor 70 to create a negative pressure in vacuum chamber 50. One section of the pressure duct 74 in the preferred embodiment forms a concave, semi-spherical dome adapted to be slightly larger than air impeller 72. The concave surface of the pressure duct 74 incorporates an intake opening 80 concentrically aligned with the rotational axis of air impeller 72. Air impeller 72 is preferably formed by a convex, semicircular arrangement of radial blades which are adapted to rotate freely within the concave portion of pressure duct 74. The intake hole 80 allows airflow to pass from vacuum chamber 50 into and around the spaces between the radial blades of air impeller 72.

The rotational axis of air impeller 72 is rigidly connected to armature shaft 71 of the rotary motor 70. The rotary motor 70, armature shaft 71, and air impeller 72 are operationally suspended above and concentrically aligned with intake 80 by motor mount 76. Motor mount 76 rigidly connects to the housing of rotary motor 70 while allowing the free rotation of armature shaft 71 and air impeller 72. Motor mount 76 in turn is supported by a plurality of rubber mounts 78 to provide quiet operation of the rotary motor 70. In operation, rotary motor 70 forcibly rotates armature shaft 71, which in turn rotates air impeller 72.

The rotating impeller blades force the air trapped between the blades to be accelerated radially toward the circumference of the impeller. Pressure duct 74 constrains the movement of the accelerated air to a path from the axis of the air impeller 72 outwardly from the intake hole 80 of pressure duct 74 along the inner concave surface of pressure duct 74 and upwardly into the plenum chamber 104. The airflow creates a negative pressure in vacuum chamber 50 and a positive air pressure in plenum chamber 104, with respect to the air pressure exterior to either chamber.

Exhaust chamber 106 is formed through the cooperation of the interior of supporting frame 30, the lower surface of support shelf 96, the interior of a stanchion 16 and a plurality of louvers 102, as shown in FIG. 2.

Exhaust chamber 106 is held in fluid communication with plenum chamber 104 through a plurality of openings 82 in support shelf 96. Exhaust chamber 106 is open to the air outside supporting frame 30 through a plurality of louvers 102 at the bottom of the device.

As additionally seen in FIG. 2, the preferred embodiment of the device provides within exhaust chamber 106, an efficient fan blade 94, a booster motor 92 and a plurality of louvers 102. The fan blade 94 is concentrically and rigidly attached to the armature shaft of booster motor 92. Booster motor 92 is rigidly connected to motor mount 98 allowing the free rotation of the armature shaft and fan blade 94. Motor mount 98 is attached through rubber mounts (not shown) to the bottom surface of support shelf 96 to provide quiet operation of booster motor 92. Also, in the preferred embodiment, a plurality of louvers 102 is suspended directly below fan blade 94. In operation, booster motor 92 is activated, in turn rotating its armature shaft and attached fan blade 94. This rotation of fan blade 94 causes air exhaust chamber 106 and air supplied to exhaust chamber 106 from plenum chamber 104 through openings 82 to be forcibly directed through louvers 102 and onto the surface supporting the device.

In an alternative embodiment of the device, booster motor 92, fan blade 94, and motor mount 98 are absent from exhaust chamber 106. In this embodiment, openings 82 are held in fluid communication with the louvers 102 through exhaust chamber 106. In operation of this alternative embodiment, the airflow created by rotary motor 70 and associated air impeller 72 is directed through openings 82, exhaust chamber 106 and downward onto the surface supporting the device through louvers 102.

Figure 3A:
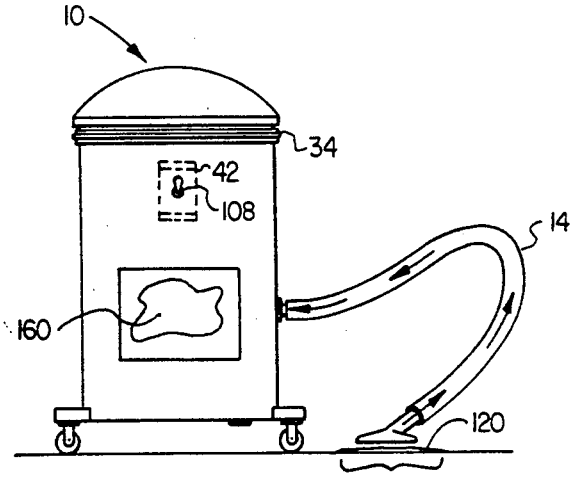
FIG. 3A shows the floor dryer and warning device during the first stage of its usage to remove a liquid from a surface using the vacuum director hose.
Figure 3B:
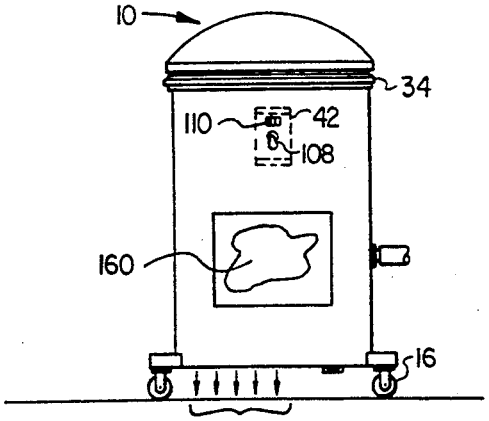
FIG. 3B shows the floor dryer and warning device stationed directly above a damp spot during the unattended drying stage of operation.

The primary use of the device is depicted in FIGS. 3A and 3B. FIG. 3A depicts the device positioned directly adjacent liquid 120 on a supporting surface. This liquid can be the result of, for example, spilled beverages in a restaurant or other public facility and may contain small particulate matter, such as broken glass or food particles. In operation, switch 108 is moved to a first position which activates the rotary motor 70 and associated air impeller 72. A vacuum is created by the spinning air impeller 72 resulting in a negative pressure within vacuum chamber 50 relative to the atmospheric pressure outside the vacuum chamber 50. The resulting vacuum is communicated through vacuum director hose 14 to liquid 120. The liquid and particulate matter become suspended in the airflow created by the vacuum and travel through the hose back to the device. Upon reaching right angle tube 64, as shown in FIG. 2, the liquid and particulate matter are directed downward into reservoir container 52. The velocity of the airstream is reduced as it expands into the larger vacuum chamber 50, and the liquid and particulate matter disassociate themselves from the airflow and fall to the bottom of reservoir container 52 where they are trapped.

As shown in FIG. 3B, the device is then stationed above the previously cleaned area to block access to the potentially dangerous damp spot and warn passersby of the potential hazard through warnings on access closure 32 or on sign 160. After being stationed above the damp spot, switch 108 is moved to a second position which deactivates rotary motor 70 and air impeller 72 and simultaneously activates booster motor 92 and indicator light 34. Switching off of the rotary motor 70 serves the purpose of conserving the life of the rechargeable battery 38 without necessarily detracting from the drying function of booster motor 92. A third position may be provided on switch 108 which allows both the rotary motor 70 and the booster motor 92 to be operated simultaneously. In this mode, the device produces the maximum airflow available through louvers 102, illustrated in FIG. 2. For small damp spots and where extended drying is not required, the additional airflow created by the rotary motor 70 and air impeller 72 will more quickly dry the damp spot.

After the damp spot has sufficiently dried, switch 108 may be moved to its original "off" position, deactivating all electronic function of the device.

In order to remove collected liquid which is stored in reservoir container 52, the device is lifted to a position where reservoir container 52 may be pulled from access portal 124 via reservoir handle 56 from the bottom of supporting frame 30 without excessive tipping of container 52. In order to remove reservoir container 52, reservoir handle 56 is grasped by the user and pulled directly downward. This downward force disengages annular groove 128 from annular ring 126 and allows reservoir container 52 to be slid out of access portal 124. Once reservoir container 52 is disengaged from the device, it may be dumped and cleaned. It may then be reinserted into the device by placing reservoir container 52 into access portal 124 and applying a reverse force on reservoir handle 56. This force pushes reservoir container 52 into access portal 124 and engages annular ring 128 with annular groove 126. Once the sealing relation of annular groove 126 is reestablished with annular ring 128, the mating relation of the two grooves provides the frictional support necessary to maintain reservoir container 52 within access portal 124. The device then may be lowered placing wheels 16 onto a surface supporting the device, and used to remove liquid from another area.

Figure 4:
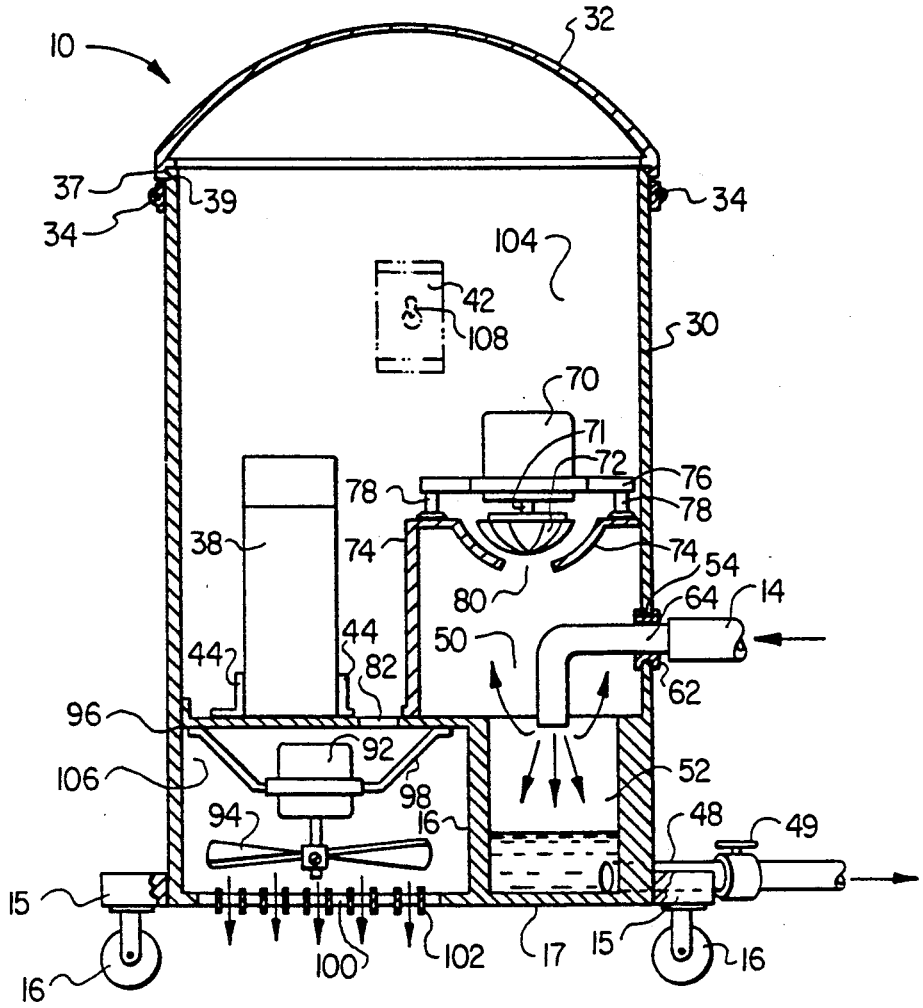
FIG. 4 is a sectional cutaway view of an alternative embodiment to the floor dryer and warning device possessing the same external features as the preferred embodiment, along the section lines 2—2 denoted in FIG. 1.

FIG. 4 shows an alternative embodiment where reservoir container 52 is formed as part of support frame 30, in place of access portal 124. In order to dump the contents of reservoir container 52 in this embodiment, a valved port 48 may be added to the device. The valved port extends and forms a conduit between the interior of reservoir container 52 to the outside of supporting frame 30. A valve 49, having at least two positions, is attached to the conduit. In the first or closed position, the conduit forms an airtight seal to the interior of reservoir container 52 with respect to the exterior of supporting frame 30. In a second or open position, the valve 49 allows the escape of liquid and particulate matter which may be contained in reservoir container 52, through valved port 48.

After removing the liquid and particulate matter from the device, the device may be cleaned for reuse by detaching the vacuum director hose 14 from the device and spraying fresh water or detergent through right angle tube 64 into the reservoir container 52. Several repetitions of this process will allow the device to be stored indefinitely or reused without further cleaning.

While the foregoing illustrates and discloses the preferred and other embodiments of the floor dryer and warning device, it is to be understood that many changes can be made in the floor dryer and warning device as a matter of engineering choice without departing from the spirit and scope of the invention as defined by the appended claims.

We claim:

1. A portable floor dryer and warning device which comprises:

a. a supporting frame adapted to be placed on a surface;

b. a vacuum chamber supported by said supporting frame;

c. a plenum chamber ductedly connected to said vacuum chamber;

d. a vacuum director having an opening at one end into said vacuum chamber and an opening at the other end exterior to said vacuum chamber;

e. a vacuum creation means, held in ducted communication with said vacuum chamber, for creating a vacuum in said vacuum chamber and expelling exhaust into said plenum chamber;

f. an exhaust direction means, held in ducted communication with said plenum chamber, for directing exhaust from said plenum chamber to impinge on said surface; and, g. a signal means, supported by said supporting frame, for drawing the attention of passersby to the presence of said device.

2. The floor dryer and warning device of claim 1 wherein said signal means includes an indicator light.

3. The floor dryer and warning device of claim 1, wherein said signal includes a sign supported by said supporting frame.

4. The floor dryer and warning device of claim 2, wherein said signal means includes an audible warning device.

5. The floor dryer and warning device of claim 1, wherein said vacuum director is adapted to flexibly extend over and contact said surface.

6. The floor dryer and warning device of claim 2, wherein said vacuum director includes a rigid plastic nozzle adapted to extend toward said surface.

7. The floor dryer and warning device of claim 2, wherein said vacuum chamber includes a removable container.

8. The floor dryer and warning device of claim 1, wherein said vacuum chamber includes a valved port having an open position and a closed position, a. said valved port being held in ducted communication with said vacuum chamber, and b. said valved port being adapted to seal said vacuum chamber in said closed position and allow liquid and over particulate to escape from said vacuum chamber in said open position.

9. The floor dryer and warning device of claim 1, wherein said vacuum creation means includes:

a. an air impeller means for creating a vacuum in said vacuum chamber; and b. a motor means, supported by said supporting frame and operatively connected to said air impeller means, for moving said air impelling means.

10. A floor dryer and warning device which comprises:

a. a supporting frame adapted to be placed on a base surface, said supporting frame supporting a vacuum chamber, a plenum chamber, and an exhaust chamber, said plenum chamber being held in ducted communication with said vacuum chamber and said exhaust chamber by said supporting frame;

b. a vacuum director means, having an opening at one end in said vacuum chamber and an opening at the other end exterior to said supporting frame and for transmitting liquid and other particulate into said vacuum chamber;

c. a vacuum creation means, attached to said supporting frame, for creating a vacuum in said vacuum chamber and dispelling exhaust into said plenum chamber;

d. an exhaust direction means, supported by said supporting frame, for directing air and exhaust out of said exhaust chamber to impinge on said base surface; and, e. a signal device supported by said supporting frame.

11. The floor dryer and warning device of claim 13, wherein said exhaust direction means includes:

a. a fan means for directing air and exhaust to impinge on said base surface, and b. a booster motor means, supported by said supporting frame and operatively connected to said fan means, for driving said fan means.

12. The floor dryer and warning device of claim 10, wherein said signal device includes an indicator light.

13. The floor dryer and warning device of claim 10, wherein said signal device includes a sign.

14. The floor dryer and warning device of claim 10, wherein said signal device includes an audible warning device.

15. The floor dryer and warning device of claim 10, wherein said signal device includes said supporting frame being brightly colored to draw attention of passersby to the presence of the device.

16. The floor dryer and warning device of claim 10, wherein said vacuum director means is adapted to flexibly extend over and contact said base surface.

17. The floor dryer and warning device of claim 10, wherein said vacuum director means includes a rigid nozzle adapted to extend toward said base surface.

18. The floor dryer and warning device of claim 10, wherein said vacuum chamber includes a removable container.

19. The floor dryer and warning device of claim 10, wherein said vacuum chamber includes a valved port having an open position and a closed position;

a. said valved port being held in ducted communication with said vacuum chamber, and b. said valved port being adapted to seal said vacuum chamber in said closed position and allow liquid or other particulate to escape from said vacuum chamber in said open position.

20. The floor dryer and warning device of claim 10, wherein vacuum creation means includes a rotary motor supported by said supporting frame and operatively connected to an air impeller.

21. The floor dryer and warning device of claim 20, wherein said rotary motor is powered by at least one rechargeable battery.

22. A portable floor dryer and warning device for removing liquid or particulate from a surface which comprises:

a. a supporting frame adapted to be placed on said surface, said supporting frame having a vacuum chamber, a plenum chamber, and an exhaust chamber, said plenum chamber being ductedly connected to said exhaust chamber and said vacuum chamber;

b. a warning means, supported by said supporting frame, for drawing the attention of passersby to the presence of said device;

c. a vacuum director means having an opening at one end into said vacuum chamber and an opening at the other end exterior to said vacuum chamber for removing said liquid and other particulate into said vacuum chamber;

d. a vacuum creation means, attached to said supporting frame; for creating a vacuum in said vacuum chamber, said vacuum creation means including, i. an impeller means for creating a negative pressure in said vacuum chamber and dispelling exhaust into said plenum chamber, and ii. a rotary motor means, operatively connected to said air impeller means and supported by said supporting frame, for powering said air impeller means, and e. an exhaust direction means, ductedly connected to said exhaust chamber and supported by said supporting frame, for directing air and exhaust in said exhaust chamber and dispelling said air and exhaust to impinge on said surface.

23. The floor dryer and warning device of claim 22, wherein said warning means includes an indicator beacon.

24. The floor dryer and warning device of claim 22, wherein said warning means includes a sign supported by said supporting frame.

25. The floor dryer and warning device of claim 22, wherein said warning means includes an audible device.

26. The floor dryer and warning device of claim 22, wherein said warning means includes said supporting frame being brightly colored to draw the attention of passersby to the presence of the device.

27. The floor dryer and warning device of claim 22, wherein said vacuum director means is adapted to flexibly extend over and contact said base surface.

28. The floor dryer and warning device of claim 22, wherein said vacuum director means includes a rigid nozzle.

29. The floor dryer and warning device of claim 22, wherein said vacuum chamber includes a removable container.

30. The floor dryer and warning device of claims 28 or 29, wherein said rigid nozzle and said removable container are formed in one piece.

* * * * *

UNITED STATES PATENT AND TRADEMARK OFFICE

CERTIFICATE OF CORRECTION

PATENT NO. : 5,208,940
DATED : May 11, 1993
INVENTOR(S) : Charles Alan London

It is certified that error appears in the above-indentified patent and that said Letters Patent is hereby corrected as shown below:

Column 1, line 67, change "aide" to --aid--.

Column 2, line 66, change "an" to --a--.

Column 5, line 1, change "prospective" to --perspective--.

Column 5, line 25, change "colored of flexible" to --colored flexible--.

Column 7, line 35, change "ma not be" to --may not be--.

Col. 11, Claim 3, line 2, change "signal includes" to --signal means includes--.

Col. 11, Claim 4, line 1, change "claim 2" to --claim 1--.

Col. 11, Claim 6, line 1, change "claim 2" to --claim 1--.

Col. 11, Claim 7, line 1, change "claim 2" to --claim 1--.

Col. 11, Claim 8, line 8, change "over" to --other--.

Col. 11, Claim 9, line 7, change "impelling" to --impeller--.

UNITED STATES PATENT AND TRADEMARK OFFICE

CERTIFICATE OF CORRECTION

PATENT NO. : 5,208,940

DATED : May 11, 1993

INVENTOR(S) : Charles Alan London

It is certified that error appears in the above-identified patent and that said Letters Patent is hereby corrected as shown below:

Col. 12, Claim 11, line, change "claim 13" to --claim 10--.

Signed and Sealed this

First Day of February, 1994

Bruce Lehman

*Attest:*

BRUCE LEHMAN

*Attesting Officer*

*Commissioner of Patents and Trademarks*